United States Patent [19]

Newton et al.

[11] 4,121,599

[45] Oct. 24, 1978

[54] FILTER

[75] Inventors: Richard Paul Newton; Lawrence Edmond Gravely, both of Louisville, Ky.

[73] Assignee: Brown & Williamson Tobacco Corporation, Louisville, Ky.

[21] Appl. No.: 719,631

[22] Filed: Sep. 1, 1976

[51] Int. Cl.[2] ..... A24B 15/027

[52] U.S. Cl. ..... 131/261 R; 131/264

[58] Field of Search ..... 131/10, 261 R, 261 A, 131/265, 267; 55/97, 524, 528, 74, 526; 195/54, 62, 63, 65, 66 R, 127, 103.5 R, 2, 3, 4; 252/427; 210/38 B

[56] References Cited

U.S. PATENT DOCUMENTS

| | | | |
|---|---|---|---|
| 3,246,655 | 4/1968 | Spears et al. | 131/267 |
| 3,353,317 | 11/1967 | Keith et al. | 131/265 |
| 4,021,368 | 5/1977 | Nemec et al. | 252/427 |
| 4,067,821 | 1/1978 | Votapek | 252/427 |
| 4,071,037 | 1/1977 | Scheinberg | 131/266 |

FOREIGN PATENT DOCUMENTS

| | | | |
|---|---|---|---|
| 2,151,814 | 4/1973 | France | 131/264 |

OTHER PUBLICATIONS

*Yeast Technology* by White, pp. 173 & 174, publ. by Wiley & Sons, New York, N.Y. 1954.

*Primary Examiner*—Robert W. Michell
*Assistant Examiner*—V. Millin
*Attorney, Agent, or Firm*—William J. Mason; Charles G. Lamb

[57] ABSTRACT

A filter for treating fluids, particularly tobacco smoke, is described having a filter media prepared from a wide variety of fungal mycelia or yeasts.

16 Claims, 3 Drawing Figures

FILTER

FIELD OF THE INVENTION

The invention relates to improved filters, particularly filters for removing particulate matter from gaseous streams. The filters of the present invention are comprised of a filter media prepared from fungal mycelia or yeast contained within a suitable container, and are especially useful in the filtration of tobacco smoke.

BACKGROUND OF THE INVENTION

While it is known in the prior art to use various fungi in the preparation of sheet-like paper products, as exemplified by U.S. Pat. No. 2,811,442, which discloses the use of mycelium from various natural fungi, such as mushroom and aquatic fungi, in paper sheet manufacture, and U.S. Pat. No. 2,026,253, disclosing the preparation of transparent or semi-transparent sheet material from paper mill slimes, the only apparent recognition of the utility of fungal mycelia or yeast in relation to filtration is disclosed in French Pat. No. 2,151,814. In this latter patent, cotton is soaked in a milk solution containing green kaolin and a minor amount of powdered yeast and thereafter dried, cut and rolled into the form of a cigarette filter.

There has been no appreciation in the prior art, however, of the present discovery that improved filters can be prepared using as the filter media yeast or fungal mycelia when in particulate form. Furthermore, there has been no recognition of the filtration efficiency of such filters, particularly in relation to the removal of particulate matter from gaseous streams, such as tobacco smoke.

SUMMARY OF THE INVENTION

It is the primary object of the present invention to provide improved filters, especially filters for removing particulate matter from gaseous streams.

It is another object to provide improved filters comprised of a filter media of fungal mycelia or yeast in particulate form held within a suitable container.

Still another object is to provide an improved method for removing particulate matter from a fluid stream, especially a gaseous stream, comprising interposing in the stream a filter media comprised of fungal mycelia or yeast in particulate form.

Particular objects of the present invention are to provide improved biodegradable tobacco smoke filters comprised of fungal mycelia or yeast in particulate form contained by a cylindrical wrapper, and cigarettes having such filters attached thereto.

Other objects, if not specifically set forth herein, will be apparent upon reading the description of the preferred embodiments which follow.

BRIEF DESCRIPTION OF THE DRAWING

Referring to the drawing.

DESCRIPTION OF THE PREFERRED EMBODIMENTS

The filter media employed in achieving the objects of the present invention may be prepared, for example, by growing the desired fungal mycelium or yeast in a suitable nutrient under agitation, harvesting and drying the resultant material, and thereafter reducing the material to a particulate form. While the following examples disclose a particular procedure, it will be obvious to the skilled artisan that other techniques and modifications to the disclosed procedure can be utilized.

Fungi are chlorophyll-free plants that are composed of branching, filamentous (thread-like) structures called hyphae. Hyphae may occur in masses or aggregations collectively known as mycelia. Hyphae may be septate or nonseptate. Fungi reproduce sexually or asexually by spores. Fungi vary greatly in size but generally range from about 1 micron wide or greater by about 1 micron long or greater.

Yeasts are a broad class of fungal microorganisms that are distinguishable from other fungi because they occur as single spherical or oval cells usually without the branching filaments (hyphae) that characterize other fungi. Yeast cells are approximately 1–5 microns wide by 5–30 microns long or greater. They reproduce vegetatively (budding) or by the formation of ascospores.

The classes Phycomycetes, Ascomycetes, Fungi Imperfecti and Basidiomycetes are of particular interest in the practice of the present invention. It is to be understood that mixtures of fungal mycelia and yeast are also contemplated.

The term "particulate" is used herein in the broad sense to describe particles or pieces of fungal mycelia or yeast. Such particulate materials may be formed, for example, by granulating, shredding or cutting. Other techniques will be apparent to the skilled artisan. Particles prepared in accordance with the procedures described herein have an average dimension in the range of from about 125 to about 3,300 microns, and particle sizes within this range are preferably used. It is to be understood, however, that particle sizes outside this range are operable and within the scope of the present invention.

Figure 1:
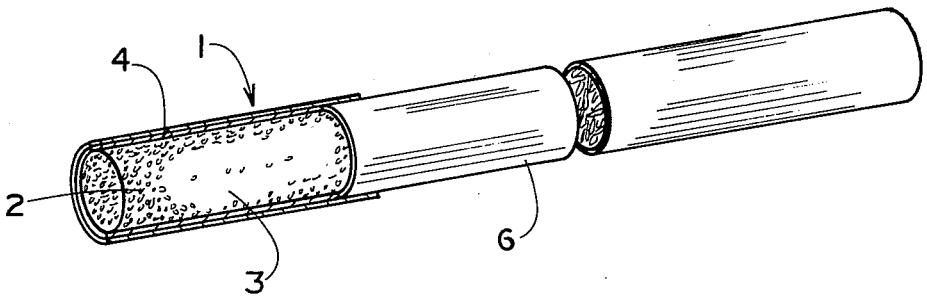
FIG. 1 is a perspective view, partially cut away, of a preferred filter of the present invention.

To form the filters 1 of the present invention as shown in FIG. 1, the above particulate filter media 2 is placed in a suitable container 4 adapted to maintain the filter media 2 in the fluid stream to be filtered. The particular configuration of the container 4 will depend, of course, on the type of filtration desired and the particular end use made of the filter 1, the only requirements being that the container 4 comprise a body portion for holding the filter media 2 with openings communicating with the interior of said body portion, permitting ingress and egress of the fluid being filtered.

Figure 2:
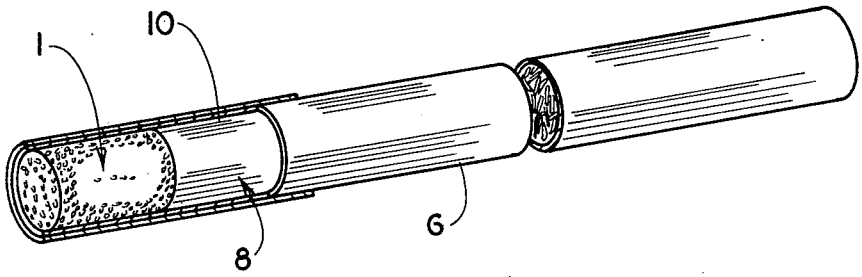
FIG. 2 is a perspective view, partially cut away, of another preferred filter of the present invention; and, FIG. 3 is a perspective view, partially cut away, of even another preferred filter of the present invention.
Figure 3:
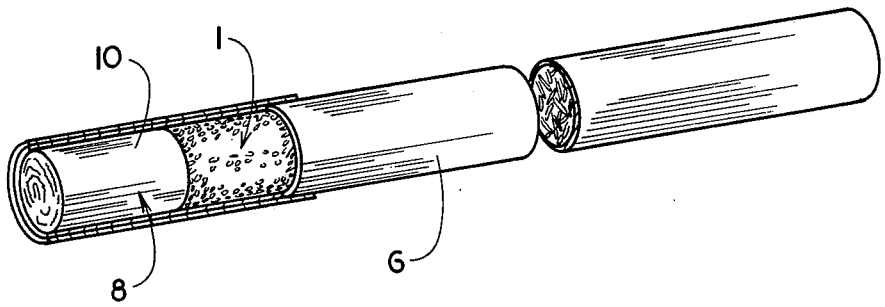

As aforementioned, the present filters are particularly useful in the filtration of tobacco smoke. For this end use, the filter 1 is comprised of a cylindrical wrapper portion, having a diameter substantially equal to that of the cigarette 6 to which it is to be attached, and generally formed of paper, containing the filter media 2 within its interior. The filter 1 may additionally contain filter segments 8 of other filtration media (FIGS. 2 and 3), axially aligned with and abutting one or both ends of the filter 1 of the present invention. The additional filter segments 8 may be formed of any conventional filter material 10; e.g., cellulose acetate, paper or polyolefin, and aid in preventing loss of filter media from the paper wrapper in addition to their filtration function.

The filter media 2 of the present invention may also be employed in admixture with a second filtration material, such as cellulose acetate fibers, carbon, or the like. Flavorants and other additives may also be combined with the filter media. Additionally, the filter media 2 may be agglomerated with a suitable binder 3 to provide a coherent structure. The binder 3 employed is desirably of a biodegradable nature so as not to detract from the biodegradable nature of the filter. Suitable binders 3 include carboxymethyl cellulose, glycerol, methyl cellulose, corn syrup and the like.

The filters 1 and the manner in which they are prepared will be more fully understood when considering the following illustrative examples.

EXAMPLE I

Culture Growth/Collection

The microorganisms listed below in Table I by their American Type Culture Collection Accession Number (ATCC) were grown on the indicated agar slant medium. After approximately 72 hours, the slant medium was washed with 10 mls of sterile distilled water. The resulting cell or spore suspension was used to inoculate a 500 ml flask containing 250 ml of the indicated media at a 4% (v/v) rate. The broth was agitated at 106 rpm and room temperature for approximately 72 hours, and was used to inoculate 3 liters of the indicated media in a 6 liter flask at a 4.2% (v/v) rate. The resulting broth was again agitated at 106 rpm and room temperature for approximately 72 hours. The mature culture was then centrifuged, collected, freeze-dried and stored for future use, the freeze-drying serving to dehydrate the material for storage. The pH of the collected culture when used as a filter material is indicated in Table I.

TABLE I

Culture Growth/Collection

| ATCC # | Growth Media (d) | Culture | pH When Used as Filter Materials |
|---|---|---|---|
| 1004 | (a) | *Aspergillus Niger* | 5.92 |
| 14151 | (a) | *Neurospora Sitophila* | 6.59 |
| 12997 | (b) | *Choanephora Cucurbitarum* | 6.09 |
| 14701 | (b) | *Pellicularia Filamentosa* | 6.86 |
| 9478 | (b) | *Penicillium Notatum* | 6.45 |
| 6205 | (b) | *Chaetomium Globosum* | 6.64 |
| 12266 | (a) | *Syncephalastrum Racemosum* | 6.15 |
| 16995 | (b) | *Polyporus Adustus* | 6.37 |
| 16409 | (b) | *Aphanomyces Euteiches* | 5.92 |
| 13210 | (b) | *Botrytis Bifurcata* | 5.58 |
| 6795b | (b) | *Cunninghamella Elegans* | 6.39 |
| 13631 | (b) | *Trichoderma Viride* | 6.57 |
| 13131 | (b) | *Ustilago Maydis* | 6.27 |
| 2471 | (b) | *Saccharomyces Capsularis* | 6.20 |
| 10679 | (b) | *Trigonopsis Variabilis* | 6.28 |
| 16322 | (a) | *Fusarium Oxysporum* | 5.20 |
| 16039 | (b) | *Sporobolomyces Holsaticus* | 6.47 |
| 9950 | (c) | *Candida Utilis* | 5.0 |
| — | (c) | Baker's Yeast (*Saccharomyces Cerevisiae*) | 5.89 |
| None | | Cellulose Acetate | 5.0 |

(a) Malt Extract Broth
(b) Yeast Malt Broth (g/l)
3g Yeast Extract
3g Malt Extract
5g Peptone
10g Dextrose
(c) Sucrose Broth (g/l)
50g Sucrose
10g Peptone
3g Yeast Extract
1g Ammonium Citrate
0.2g Dipotassium Phosphate
(d) Agar slants were made as for broths except that 2% (w/v) agar was added.

EXAMPLE II

Filter Media Preparation

The mycelia materials indicated in Table II were prepared into sheets and shredded to form particles which were then used for filter construction. Granules were used for those materials; i.e., yeasts, where sheet data is not specified. The weights of dry materials, volume of water, amount of glycerol and blending time are specified in Table II for the slurry formation for mycelia sheet manufacture. The glycerol is added to the slurry to prevent sticking of the sheet. The mycelia sheets were prepared by mixing the indicated ingredients and casting them on a stainless steel sheet over a 100° C. steam bath. The resultant mycelia sheets were shredded twice on a conventional paper shredder at 32 cuts per inch.

The indicated yeast materials were not cast for filter construction. Rather, they were taken in their freeze-dried state, as prepared in accordance with Example I, and chopped into granules with a razor blade. The granules were then used for filter construction. In either case, the average particle size of the mycelia and yeast materials was from about 125 to about 3,300 microns.

TABLE II

Conditions of Slurry Formation for Mycelia Sheet Manufacture[1]

| Materials | Wt. of Dry Materials (g) | Vol. of Water (ml) | Glycerol (ml) | Blending Time (min) |
|---|---|---|---|---|
| *Aspergillus Niger* | 2 | 75 | 0.13 | 2 |
| *Neurospora Sitophila* | 2 | 75 | 0.13 | 2 |
| *Choanephora Cucurbitarum* | 2 | 75 | 0.13 | 4 |
| *Pellicularia Filamentosa* | 1 | 37.5 | 0.06 | 2 |
| *Penicillium Notatum* | 1 | 37.5 | 0.06 | 2 |
| *Chaetomium Globosum* | 1 | 37.5 | 0.06 | 2 |
| *Syncephalastrum Racemosum* | 1 | 37.5 | 0.06 | 2 |
| *Polyporus Adustus* | 1 | 37.5 | 0.06 | 2 |
| *Aphanomyces Euteiches* | 1 | 37.5 | 0.06 | 2 |
| *Botrytis Bifurcata* | 1 | 37.5 | 0.06 | 2 |
| *Cunninghamella Elegans* | 1 | 37.5 | 0.06 | 2 |
| *Trichoderma Viride* | 0.07 | 37.5 | 0.06 | 2 |
| *Ustilago Maydis* | | Granules Used | | |
| *Saccharomyces Capsularis* | | Granules Used | | |
| *Trigonopsis Variabilis* | | Granules Used | | |
| *Fusarium Oxysporum* | 0.07 | 37.5 | 0.06 | 2 |
| *Sporobolomyces Holsaticus* | | Granules Used | | |
| *Candida Utilis* | | Granules Used | | |
| Baker's Yeast | | Granules Used | | |

[1]Materials 1–3 were blended in a quart Waring Blender jar. Materials 4–7 were blended in a Waring mini-micro blending cup. Materials 8–12 and 16 were blended in an Eberbach semi-micro blending cup. All others were used in granule form.

EXAMPLE III

Filter Construction

The mycelia particles and yeast granules prepared in accordance with Example II were used to prepare cigarette filters. The filters were prepared by removing the 27 mm cellulose acetate filter from a conventional commercially available cigarette and cutting off an appropriate length thereof. The length of cellulose acetate that was cut off was replaced by putting the shredded or granular materials into the filter tube cavity at the tobacco end. The weight and length of the shredded or granular section is set forth in Table III. The remaining cellulose acetate section was inserted into the filter tube cavity at the mouth end, and the cigarettes were cut to 84 mm for analytical smoking.

The results of the analytical smoking of the cigarettes is set forth in Table III. The equations used in calculating the efficiency of the indicated materials was as follows:

$$\text{Equation I:} \quad \theta_f = \frac{S_1 - S_2}{S_1}$$

$$\text{Equation II:} \quad \theta_m = \frac{\theta_f - \theta_{ca}}{1 - \theta_{ca}}$$

where $\theta_f$ = Fractional efficiency for nicotine, entire filter; $S_1$ = total nicotine delivered to filter; and $S_2$ = nicotine delivered from filter; $\theta_m$ = Fractional efficiency for nicotine, test section of filter (adjusts for cellulose acetate contribution to filtration); and $\theta_{ca}$ = nicotine filtration efficiency for 20 mm cellulose acetate section.

$$\text{Equation III:} \quad K_p = \frac{-1_n(1 - \theta_m)}{PD_{m(cm)}}$$

where $K_p$ = Filter performance coefficient (adjusts for filter pressure drop); and $PD_{m(cm)}$ = pressure drop of test section in centimeters, water gauge.

Some properties of the mycelia and yeast filter materials of the present invention were determined, and were compared to those of cellulose acetate. For example, it was determined that the pH of the mycelia and yeast filter materials range from about 5.0 to about 6.8, as compared to 5.0 for cellulose acetate (Table I). Also, it was determined that the present filter materials generally exhibit greater water susceptibility than does cellulose acetate (Table IV).

The efficiency of the present filter materials, compared to that of cellulose acetate, was determined with respect to nicotine and tar deliveries (Table V); and hydrogen cyanide and acetaldehyde gas phase deliveries (Table VI).

The multiple filters set forth in the tables were prepared by replacing a portion of the cellulose acetate used in commercial cigarette filters with a mycelia or yeast material. In the case of dual filters, the mycelia or yeast material was inserted in the filter tube closest the tobacco end of the cigarette, whereas in the triple filters, the mycelia or yeast material was used as the center section of the filter while cellulose acetate was inserted into the filter tube closest the tobacco end and the mouth end.

In Table V, the reference notations have the meanings given at the bottom of Table VI.

TABLE III:

| Source of Material | Microbial Materials Nicotine Efficiency PD (cm W.G.) | $\theta$ F(×100) | $\theta$ M(×100)* | Kp | Weight of Test Materials (mg) | Length of Test Section (mm) | |
|---|---|---|---|---|---|---|---|
| CA Control-1 (av. of 5) | 6.1 | 41.0 | — | 0.091 | — | 27 | |
| CA Control-2 | 4.53 | 32.0 | — | 0.091 | — | 20 | (7 mm void) |
| *ASPERGILLUS NIGER* | 1.40 | 32.4 | 0 | — | 100 | 7 | |
| *NEUROSPORA SITOPHILA* | 1.37 | 30.3 | 0 | — | 100 | 7 | |
| *CHOANEPHORA CUCURBITARUM* | 0.86 | 32.9 | 0 | — | 100 | 7 | |
| *PELLICULARIA FILAMENTOSA* | 0.97 | 29.0 | 0 | — | 100 | 7 | |
| *PENICILLIUM NOTATUM* | 1.96 | 39.8 | 9.2 | 0.050 | 100 | 7 | |
| *CHAETOMIUM GLOBOSUM* | 1.24 | 35.9 | 3.3 | 0.026 | 100 | 7 | |
| *SYNCEPHALASTRUM RACEMOSUM* | 2.01 | 40.3 | 10.0 | 0.052 | 100 | 7 | |
| *POLYPORUS ADUSTUS* | 4.09 | 39.5 | 8.7 | 0.022 | 100 | 7 | |
| *APHANOMYCES EUTEICHES* | 2.11 | 38.5(est) | — | — | 100 | 7 | |
| *BOTRYTIS BIFURCATA* | 0.71 | 39.6 | 8.9 | 0.131 | 100 | 7 | |
| *CUNNINGHAMELLA ELEGANS* | 0.33 | 47.3 | 20.5 | 0.676 | 100 | 7 | |
| *TRICHODERMA VIRIDE* | Insignificant | 47.7 | 21.1 | — | 70 | 7 | |
| *USTILAGO MAYDIS* | 1.55 | 42.1 | 12.7 | 0.086 | 70 | 7 | |
| *SACCHAROMYCES CAPSULARIS* | 1.91 | 34.3 | 0.9 | 0.005 | 70 | 7 | |
| *TRIGONOPSIS VARIABILIS* | 2.24 | 35.2 | 2.3 | 0.010 | 70 | 7 | |
| *FUSARIUM OXYSPORUM* | 2.03 | 42.3 | 13.0 | 0.068 | 50 | 7 | |
| *SPOROBOLOMYCES HOSLATICUS* | 2.08 | 34.3 | 0.9 | 0.004 | 70 | 7 | |
| *CANDIDA UTILIS* | 6.83 | 43.1 | 14.2 | 0.022 | 80 | 7 | |
| BAKER'S YEAST | — | — | — | — | 264 | 13 | |

*Historical $\theta_f$ value of 33.7 used for $\theta_m$ calculations of materials.

TABLE IV:

CHANGES IN FILTER MATERIALS AFTER STATIC AND AGITATED EXPOSURE TO WATER

| Source of Material | Static Exposure Time (min.) 2 | 10 | 30 | 60 | Blended (0.5 min.) | Condition of Solution After Blending | Disposition Of Particles |
|---|---|---|---|---|---|---|---|
| *NEUROSPORA SITOPHILA* | NC | NC | NC | SL | Complete | Cloudy | Settled |
| *PENICILLIUM NOTATUM* | SL | SL | SL | SL | Complete | Opaque | Suspended |
| *SYNCEPHALASTRUM RACEMOSUM* | NC | NC | NC | NC | Complete | Cloudy | Float & Settled |
| *USTILAGO MAYDIS* | SL | SL | MOD | COM | — | Cloudy | Suspended |
| *FUSARIUM OXYSPORUM* | SL | SL | SL | MOD | Complete | Light Purple | Settled |
| *BOTRYTIS BIFURCATA* | NC | NC | NC | NC | Complete | Brown | Settled |
| *CUNINGHAMELLA ELEGANS* | NC | NC | NC | NC | Complete | Clear | Settled |
| *CHAETOMIUM GLOBOSUM* | NC | SL | SL | SL | Complete | Cloudy | Settled |
| *CHOANEPHORA CURCURBITARUM* | NC | NC | NC | NC | Complete | Cloudy | Settled-Suspended |
| *POLYPORUS ADUSTUS* | NC | NC | NC | NC | Complete | Cloudy | Settled-Suspended |
| *PELLICULARIA FILAMENTOSA* | SL | SL | SL | MOD | Complete | Brown | Settled |
| *APHANOMYCES EUTEICHES* | ND | | | | | | |
| *SACCHAROMYCES CAPSULARIS* | NC | MOD | MOD | COM | — | Very cloudy | Suspended |
| *ASPERIGILLUS NIGER* | NC | SL | SL | SL | Complete | Clear | Floating |
| BAKER's YEAST | COM | — | — | — | — | Cloudy | Suspended |
| *TRIGONOPSIS VARIABILIS* | MOD | COM | — | — | — | Cloudy | Suspended |
| *TRICHODERMA VIRIDE* | NC | NC | NC | NC | Complete | Opaque | Suspended |
| *SPOROBOLOMYCES HOLSATICUS* | MOD | COM | — | — | — | Cloudy | Suspended |
| Control-Cellulose Acetate | NC | NC | NC | NC | Shredded | Clear | Settled |

TABLE IV:-continued

CHANGES IN FILTER MATERIALS AFTER STATIC AND AGITATED EXPOSURE TO WATER

| Source of Material | Static Exposure Time (min.) 2 | 10 | 30 | 60 | Blended (0.5 min.) | Condition of Solution After Blending | Disposition Of Particles |
|---|---|---|---|---|---|---|---|
| Control-Cellulose Acetate | NC | NC | NC | NC | Shredded | Clear | Settled |

NC = No change
SL = Slight
MOD = Moderate
COM = Complete
ND = No Data.

TABLE V:

NICOTINE AND TAR DELIVERIES FOR NATURAL FILTER MATERIALS - MULTIPLE CONSTRUCTION

| Material | Puff Number | mg/puff Nicotine Delivery | Nicotine Retained | Tar | TPM (Dry) | Filter Efficiency (%) |
|---|---|---|---|---|---|---|
| Control #1* | 6.4 | 0.14 | 0.09 | 2.00 | 2.14 | 39.5 |
| *ASPERGILLUS NIGER* | 6.1 | 0.15 | 0.07 | 2.26 | 2.43 | 32.4 |
| *NEUROSPORA SITOPHILA* | 6.8 | 0.15 | 0.06 | 2.16 | 2.25 | 30.3 |
| *CHOANEPHORA CUCURBITARUM* | 7.1 | 0.15 | 0.07 | 2.14 | 2.30 | 32.9 |
| *PELLICULARIA FILAMENTOSA* | 6.5 | 0.24 | 0.10 | 2.25 | 2.40 | 37.7 |
| Control #2 | 6.4 | 0.15 | 0.12 | 1.84 | 2.00 | 43.9 |
| *PENICILLIUM NOTATUM* | 6.6 | 0.15 | 0.10 | 2.06 | 2.21 | 39.9 |
| *CHAETOMIUM GLOBOSUM* | 6.5 | 0.15 | 0.09 | 2.02 | 2.17 | 35.9 |
| Control #3 | 7.2 | 0.13 | 0.09 | 1.71 | 1.83 | 41.9 |
| *APHANOMYCES EUTEICHES* | 7.3 | 0.13 | 0.08(est) | 1.74 | 2.01 | 38.0(est) |
| *CUNNINGHAMELLA ELEGANS* | 6.5 | 0.14 | 0.12 | 1.91 | 2.05 | 47.3 |
| *TRICHODERMA VIRIDE* | 6.9 | 0.13 | 0.12 | 1.80 | 1.93 | 47.7 |
| *USTILAGO MAYDIS* | 6.7 | 0.13 | 0.10 | 1.76 | 1.90 | 42.1 |
| Control #4 | 6.4 | 0.14 | 0.10 | 1.88 | 2.01 | 42.0 |
| *SACCHAROMYCES CAPSULARIS* | 6.2 | 0.15 | 0.08 | 1.90 | 2.05 | 34.3 |
| *TRIGONOPSIS VARIABILIS* | 6.4 | 0.13 | 0.07 | 1.75 | 1.88 | 35.2 |
| Control #5 | 6.5 | 0.14 | 0.10 | 1.82 | 1.95 | 43.6 |
| *FUSARIUM OXYSPORUM* | 6.8 | 0.12 | 0.09 | 1.66 | 1.78 | 42.0 |
| *SPOROBOLOMYCES HOLSATICUS* | 6.0 | 0.15 | 0.08 | 1.92 | 2.07 | 34.3 |
| Control #6 | 7.2 | 0.13 | 0.10 | 1.77 | 1.90 | 44.8 |
| *SYNCEPHALASTRUM RACEMOSUM* | 6.2 | 0.14 | 0.09 | 1.94 | 2.07 | 40.3 |
| *POLYPORUS ADUSTUS* | 6.8 | 0.14 | 0.09 | 2.02 | 2.16 | 39.5 |
| *BOTRYTIS BIFURCATA* | 6.9 | 0.13 | 0.08 | 1.98 | 2.12 | 39.6 |
| Control #7[a] | 6.7 | 0.15 | 0.09(est) | — | — | 37.0 |
| *CANDIDA UTILIS*[b] | 7.6 | 0.14 | 0.07 | 1.79 | 1.93 | 34.0 |
| BAKER'S YEAST[c] | 6.6 | 0.16 | 0.09 | 2.20 | — | 36.0 |

TABLE VI

Gas Phase Delivery for Natural Filter Materials - Multiple Construction

| Material | Puff No. | mg/puff Total HCN | Acetaldehyde |
|---|---|---|---|
| Control #1* | 6.4 | 29 | 122 |
| *ASPERGILLUS NIGER* | 6.1 | 35 | 119 |
| *NEUROSPORA SITOPHILA* | 6.8 | 29 | 119 |
| *CHOANEPHORA CUCURBITARUM* | 7.1 | 32 | 111 |
| *PELLICULARIA FILAMENTOSA* | 6.5 | 33 | 121 |
| Control #2 | 6.4 | 30 | 123 |
| *PENICILLIUM NOTATUM* | 6.6 | 30 | 117 |
| *CHAETOMIUM GLOBOSUM* | 6.5 | 30 | 120 |
| Control #3 | 7.2 | 21 | 114 |
| *APHANOMYCES EUTEICHES* | 7.3 | 21 | 112 |
| *CUNNINGHAMELLA ELEGANS* | 6.5 | 22 | 116 |
| *TRICHODERMA VIRIDE* | 6.9 | 26 | 117 |
| *USTILAGO MAYDIS* | 6.7 | 29 | 100 |
| Control #4 | 6.4 | 25 | 120 |
| *SACCHAROMYCES CAPSULARIS* | 6.2 | 26 | 120 |
| *TRIGONOPSIS VARIABILIS* | 6.4 | 25 | 115 |
| Control #5 | 6.5 | 24 | 114 |
| *FUSARIUM OXYSPORUM* | 6.8 | 24 | 105 |
| *SPOROBOLOMYCES HOLSATICUS* | 6.0 | 26 | 125 |
| Control #6 | 7.2 | 26 | 123 |
| *SYNCEPHALASTRUM RACEMOSUM* | 6.2 | 28 | 156 |
| *POLYPORUS ADUSTUS* | 6.8 | 26 | 150 |
| *BOTRYTIS BIFURCATA* | 6.9 | 28 | 155 |
| Control #7[a] | 6.7 | 35 | 116 |
| *CANDIDA UTILIS*[b] | 7.6 | 28 | 103 |
| BAKER'S YEAST[c] | 6.6 | 37 | 107 |

*An 84 mm cigarette.
[a]Av. puff number for all other controls (6.7) used for per puff calculation.
[b]Triple filter. All others are dual filter.[c]Av. puff number for all other yeast materials (6.6) used for per puff calculations.

The data in Tables V and VI indicate that filters prepared from mycelia and yeast in accordance with the present invention have filtration properties for nicotine, tar, acetaldehyde and hydrogen cyanide that are comparable to cellulose acetate, and that filters made from mycelia of *Cunninghamella elegans* and *Trichoderma viride* gave the best results with respect to nicotine filtration. This is corroborated by the computation of "materials efficiency" set forth in Table III.

Cigarettes with filters containing particulate *Aspergillus Niger* (triple filter), *Saccharomyces Cerevisiae* (dual filter), and *Candida Utilis* (triple filter), were rated by a 10-member test panel for strength and flavor against a commercial cigarette control, and were found to be the same in these properties, except that the cigarette with the *Aspergillus Niger* filter was somewhat drier, and the cigarette with the *Saccharomyces Cerevisiae* filter was somewhat lower in strength.

While the preferred embodiments have been directed specifically to the preparation of tobacco smoke filters, it is to be understood that the present invention is applicable to the filtration of fluids in general, including liquids and gaseous streams other than tobacco smoke.

It is to be further understood that various additions and modifications may be made to the invention without departing from the spirit and scope thereof.

What is claimed is:

1. An improved tobacco smoke filter useful in the filtration of a gaseous fluid comprised of a container and a filter media in particulate form within said container, said filter media being selected from the group consisting essentially of fungal mycelia and yeast.

2. The filter of claim 1, wherein said container is comprised of a body portion having openings therein permitting ingress and egress of said fluid.

3. The filter of claim 1, wherein said container is a cylindrical wrapper of paper.

4. The filter of claim 1, wherein said filter media is selected from the classes Phycomycetes, Ascomycetes, Fungi Imperfecti and Basidiomycetes.

5. The filter of claim 1, wherein said filter media has an average particle size in the range of from about 125 to about 3,300 microns.

6. The filter of claim 1, wherein said filter media is agglomerated with a binder.

7. The filter of claim 6, wherein said binder is selected from the group consisting of carboxymethyl cellulose, glycerol, methyl cellulose and corn syrup.

8. An improved cigarette filter adapted to be attached to a tobacco column of a given diameter comprised of cylindrical filter wrapper having a diameter substantially equal to a said given diameter and a filter media in particulate form within a said wrapper, said filter media consisting essentially of a material selected from the group consisting of fungal mycelia and yeast.

9. The filter of claim 8, being additionally comprised of a second filter segment in axial alignment with said filter.

10. The cigarette filter of claim 9, wherein said second filter segment is comprised of cellulose acetate.

11. A cigarette comprised of a tobacco column enclosed in a cylindrical tobacco wrapper and a filter positioned at one end of said tobacco column, said filter being comprised of a cylindrical filter wrapper surrounding a filter media in particulate form consisting essentially of a material selected from the group consisting of fungal mycelia and yeast.

12. The cigarette of claim 11, further comprised of a second filtration segment in axial alignment with said tobacco column and said filter.

13. The cigarette of claim 12, wherein said second filtration segment is positioned opposite said filter from said tobacco column.

14. The cigarette of claim 12, wherein said second filtration segment is positioned between said filter and said tobacco column.

15. An improved method for filtering tobacco smoke comprising passing said smoke through a filter media in particulate form consisting essentially of a material selected from the group consisting of fungal mycelia and yeast.

16. The method of claim 15, wherein said filter media is selected from the classes Phycomycetes, Ascomycetes, Fungi Imperfecti and Basidiomycetes.

* * * * *